United States Patent [19]

MacDonald

[11] Patent Number: 4,620,801

[45] Date of Patent: Nov. 4, 1986

[54] UNIVERSAL SINGLE ROLLER BRACKET

[75] Inventor: Paul M. MacDonald, Scituate, Mass.

[73] Assignee: P.X. Industries, Inc., West Hanover, Mass.

[21] Appl. No.: 777,917

[22] Filed: Sep. 19, 1985

[51] Int. Cl.[4] ..... F16C 29/04; A47B 88/00

[52] U.S. Cl. ..... 384/19; 312/341 R

[58] Field of Search ..... 308/3.8, 3.6; 312/330 R, 337, 339, 340, 341 R, 342, 345, 350; D8/354, 374, 375

[56] References Cited

U.S. PATENT DOCUMENTS

| | | | |
|---|---|---|---|
| 2,202,209 | 5/1940 | Kennedy | 312/342 |
| 2,223,071 | 11/1940 | Koch | 308/3.8 |
| 2,255,290 | 9/1941 | Kennedy | 308/3.8 X |
| 3,094,363 | 6/1963 | Fremstad et al. | 308/3.8 X |
| 3,112,960 | 12/1963 | Hillson | 308/3.8 |
| 3,387,906 | 6/1968 | Edwards | 312/340 X |
| 3,980,365 | 9/1976 | MacDonald et al. | 312/345 |
| 4,095,853 | 6/1978 | MacDonald | 308/3.6 |
| 4,288,137 | 9/1981 | MacDonald | 312/341 R |
| 4,412,703 | 11/1983 | Simonson | 308/3.8 X |

*Primary Examiner*—Stuart S. Levy
*Assistant Examiner*—Thomas R. Hannon
*Attorney, Agent, or Firm*—Morse, Altman & Dacey

[57] ABSTRACT

A universal single roller bracket is disclosed for use with sliding drawers in cabinets, bureaus, chests and the like. The universal single roller bracket is self-positioning and has no right or left-handed characteristics. It includes a unitary bracket, formed either of a high impact strength plastic material or of metal. A pair of flat mounting flanges, formed integral with the bracket, extend at an angle in respective divergent planes from an apex and define an axis adjacent the apex. A pair of parallel spaced roller supports, also formed integral with the bracket, extend from the apex in planes normal to the axis and connecting with the mounting flanges. A roller, formed of a high impact strength plastic material, is supported within the roller supports for rotation about the axis. The roller can be provided with a flanged shoulder to serve as a side guide for the drawers. In the alternative, one of the pair of roller supports can be formed with shoulders for serving as the side guide.

10 Claims, 7 Drawing Figures

UNIVERSAL SINGLE ROLLER BRACKET

BACKGROUND OF THE INVENTION

1. Field of the Invention

The present invention relates generally to slide systems for drawers and, more particularly, to a universal single roller bracket for use with drawers characterized by ease of installation and smooth, quiet operation.

2. The Prior Art

Sliding drawers used in cabinets, bureaus, chests and the like have been supported for sliding movement in a variety of different ways. One of the simplest uses a rail upon which the drawer slides. Others incorporate roller assemblies used in guide systems, including telescoping tracks and cooperating rollers between the tracks. Self-centering, overhead drawer rail systems, employing a single, self-aligning rail, also are known, see U.S. Pat. No. 3,980,365. Roller guides incorporating a pair of rollers mounted on an angled bracket have been used in some cabinets, see U.S. Pat. No. 4,095,853. A more complex and expensive approach is disclosed in U.S. Pat. No. 4,228,137. This rather elaborate roller and rail system is especially useful for use in handling heavily loaded drawers subject to frequent use. Each of the above systems, as well as others, have their respective advantages and drawbacks, particularly when viewed from the standpoint of cost of manufacture and installation, simplicity and smoothness of operation. There is thus still room left for improvements.

SUMMARY OF THE INVENTION

It is a principal object of the present invention to overcome the above disadvantages by providing a universal single roller bracket for use with sliding drawers in cabinets, bureaus, chests and the like.

More specifically, it is an object of the present invention to provide a universal single roller bracket for use with sliding drawers in cabinets and the like which is self-positioning, with no right or left-handed characteristics, reducing thereby time and costs of installation and eliminating inventory confusion and mismatch. The universal single roller bracket comprises a unitary bracket formed with a pair of flat mounting flanges that extend at an angle and spaced from an apex in respective divergent planes and define an axis adjacent the apex. A pair of spaced parallel roller supports, also formed integral with the bracket, extend from the apex in planes normal to the axis and connect with the flat mounting flanges. A roller, formed of a high impact strength plastic material, is supported within the roller supports for rotation about the axis. Preferably, the roller is provided with a flanged shoulder to serve as a side guide for the drawers. In the alternative, one of the pair of roller supports serves as the side guard. The unitary bracket is formed either of a high impact strength plastic material or of metal. If the latter, the pair of flat mounting flanges also are formed with spear points temporarily to hold the bracket in position prior to it being securely fastened in and to the cabinet.

Other objects of the present invention will in part be obvious and will in part appear hereinafter.

The invention accordingly comprises the universal single roller bracket of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENTS

Figure 1:
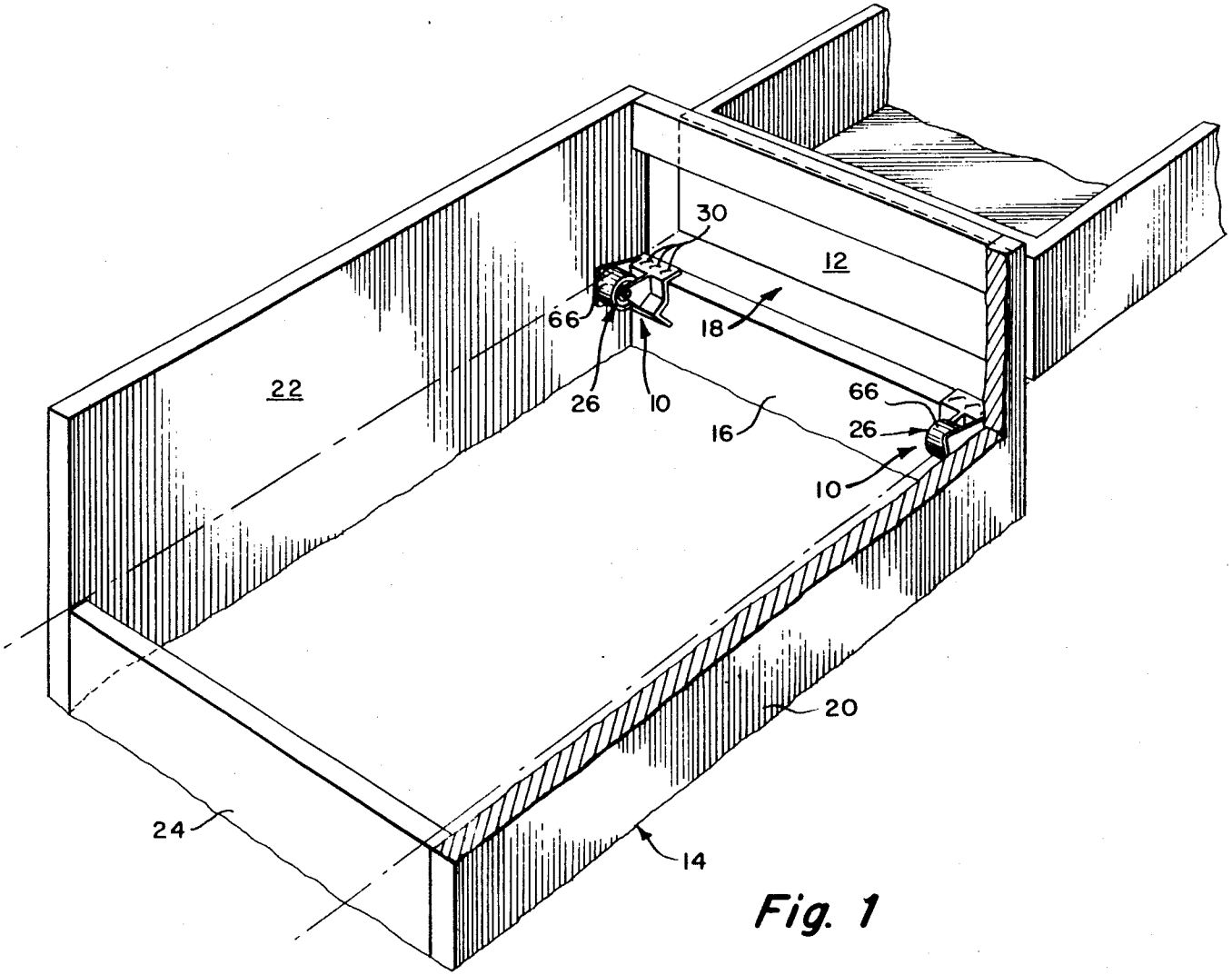
FIG. 1 is a perspective view, partially broken away, showing a slide system for drawers according to the invention and installed in a representative cabinet.

In general, the illustrated embodiments of a universal single roller bracket 10 are designed for use with a sliding drawer 12 in a cabinet 14 of typical construction. The illustrated cabinet 14 may be constructed in the form of a bathroom vanity, a kitchen cabinet, a bureau or a chest or the like and equipped with one or more drawers and typically made of wood or the like. The cabinet 14 typically includes a front panel 16 in which an opening 18 is made rectangular and slightly larger than the drawer 12 to allow free movement of the drawer 12 in and out of the cabinet 14. The cabinet 14 may, of course, be provided with more than the one illustrated drawer 12 and also may include one or more doors, not shown, depending upon the particular use of the cabinet 14. In addition to the front panel 16, the cabinet includes side walls 20 and 22 and a rear wall 24. Two universal single roller brackets 10 are mounted in the respective front two corners of the rectangular opening 18, with the two brackets 10 being mounted to the front panel 16. The two universal single roller brackets 10 are designed slidably to support the bottom edges of the drawer 12.

The universal single roller bracket 10 of the invention is not only self-positioning but features no right or left-handed characteristics (hence the name "universal"). Consequently, the same universal single roller bracket 10 is installed in each of the two corners, reducing thereby cost of installation and eliminating inventory confusion and mismatch of parts. The universal single roller bracket 10 of the invention includes two embodiments: an all-plastic construction 26 and a hybrid metal-plastic construction 28, respectively illustrated in FIGS. 2 and 3.

Figure 2:
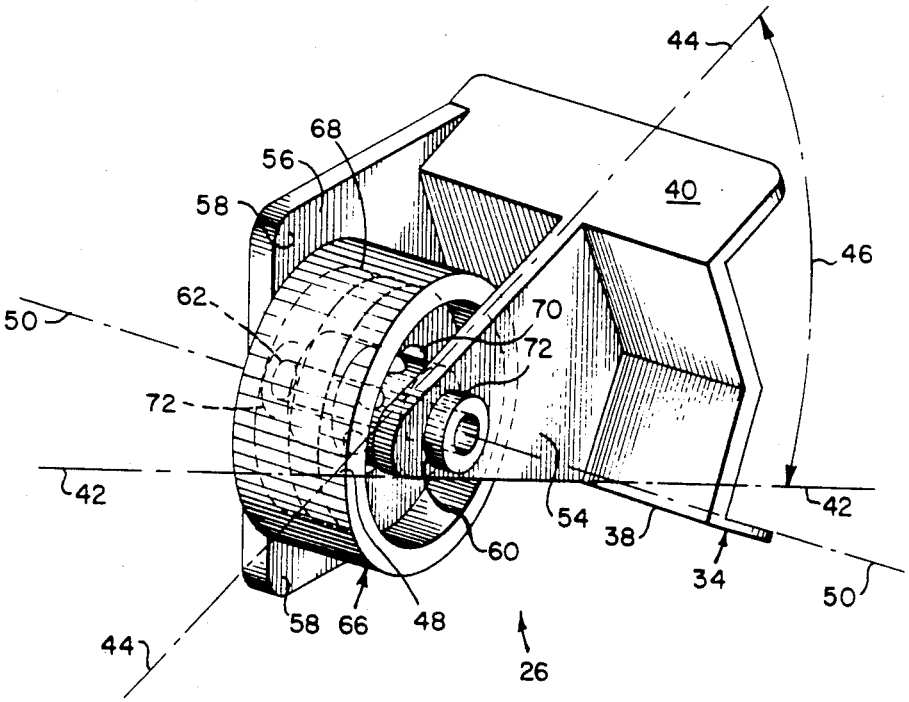
FIG. 2 is a perspective vw of a universal single roller bracket on an enlarged scale and constructed in accordance with the present invention.
Figure 4:
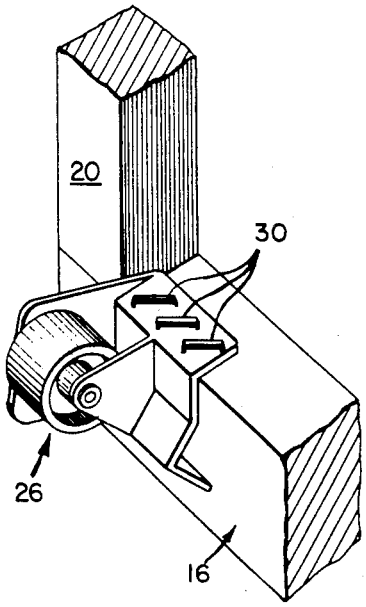
FIG. 4 is a perspective view of a corner of a cabinet and showing the universal single roller bracket of FIG. 2 fastened in place therein.
Figure 5:
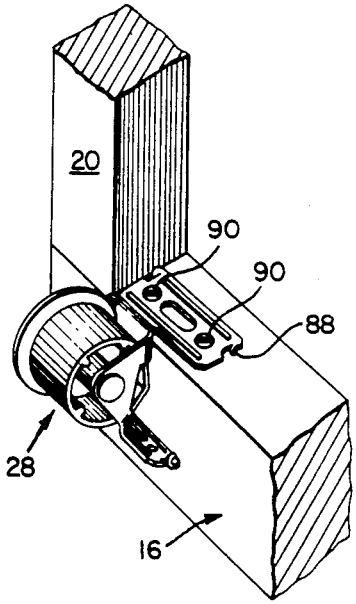
FIG. 5 is a view similar to FIG. 4 but showing the universal single roller bracket of FIG. 3 fastened in place therein.

The embodiment of the all-plastic construction 26 of a universal single roller bracket illustrated in FIG. 2 is designed for quick installation by means of staples 30, as illustrated in FIG. 4. Additionally, since it is of all-plastic construction, i.e., there is no metal-on-plastic contact or wear, this embodiment provides a durable, smooth, self-lubricating, and quiet drawer slide system. The all-plastic construction 26 of a universal single roller bracket essentially comprises a unitary bracket 34 and a roller 36 rotatably supported in the bracket 34. Both the bracket 34 and the roller 36 preferably are made from a high impact strength plastic material, such as for example, a high density polyethylene, nylon, or the like. The brackets 34 and the roller 36 can be conveniently cast in a suitable die or they can be injection formed, all as well known in the plastics forming art.

The unitary bracket 34 is formed with a pair of flat mounting flanges 38 and 40. The mounting flanges 38 and 40 are formed in planes 42 and 44 converging at an angle 46 toward an apex 48 and defining an axis 50 near the apex 48. It is these flanges 38 and 40 and their disposition in the converging (or diverging, if viewed from the apex 48) planes 42 and 44 that provide the universal single roller bracket with its unique universal, self-positioning feature. Preferably, the angle 46 is about 60°. A pair of spaced parallel roller supports 54 and 56 extend from the apex 48 in spaced parallel planes normal to the axis 50 and connect with the mounting flanges 38 and 40. One roller support 54 is of triangular shape and the other roller support 56 is angular, featuring a pair of shoulders 58, 58. These shoulders 58, 58 serve as side guides for the drawer 12 and keep the drawer 12 from rubbing against the side walls 20 and 22 when the drawer 12 is slid in and out of the opening 18. Each of the pair of roller supports 54 and 56 is provided with a hole 60 and 62, respectively. The holes 60 and 62 are formed in the pair of roller supports 54 and 56 adjacent the apex 48 and concentric with the axis 50.

A roller 66 is designed for being rotatably supported within the pair of roller supports 54 and 56, specifically within the respective hole 60 and 62 formed in the supports 54 and 56. The roller 66 is formed of a high impact strength plastic material, as by casting or injection forming. The plastic material preferably is a high density polyethylene or nylon. The roller 66 is formed with a cylindrical outer periphery 68 and a central tubular hub 70. The hub 70 itself is formed with reduced end portions 72, 72 designed rotatably to be accomodated within the support holes 60 and 62 of the supports 54 and 56. The diameter of the roller 66 is such that its cylindrical outer periphery 68 extends beyond the supports 54 and 56.

Figure 7:
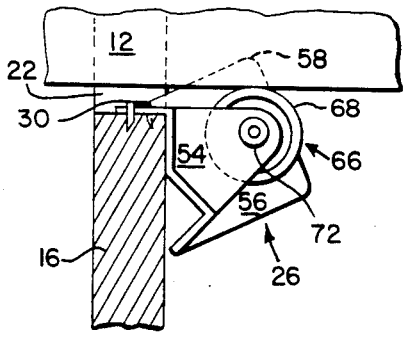
FIG. 7 is a view similar to FIG. 6 but illustrating the universal single roller bracket of FIG. 2 secured to the cabinet part.

The securing of the all-plastic embodiment 26 of a universal single roller bracket in and to a corner of the cabinet 14 is illustrated in FIG. 4. In FIG. 4 is shown the attachment of the all-plastic embodiment 26 in a right-hand front corner of the cabinet 14 by being stapled to the back side of the front panel 16 as by staples 30. An attachment of the all-plastic embodiment 26 of a universal single roller bracket in the left-hand front corner of the cabinet 14 is illustrated in FIG. 7. With the drawer 12 also shown therein, it can be seen how the cylindrical periphery 68 of the roller 66 supports the underside of the drawer 12 as it slides with a slight clearance above the edge of the front panel 16. It can also be observed that one shoulder 58 of one 56 of the pair of spaced parallel roller supports 54 and 56 serves as a side guide for the drawer 12.

Figure 3:
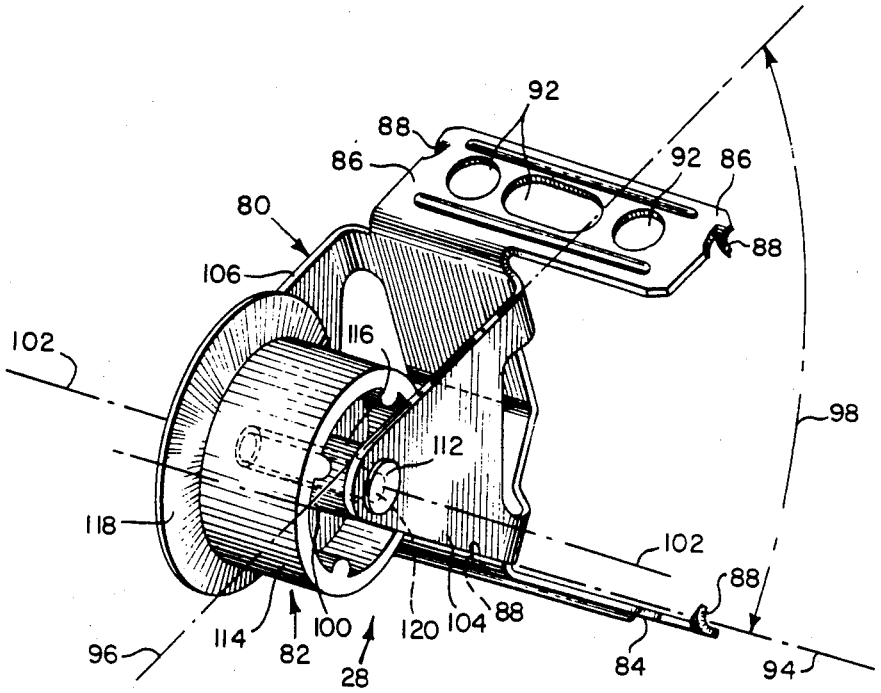
FIG. 3 is a view similar to FIG. 2 but showing a different embodiment thereof.

The metal-plastic embodiment 28 of a universal single roller bracket according to the invention is illustrated in FIG. 3. This hybrid metal-plastic embodiment 28 also essentially comprises a unitary bracket 80, this time formed of metal, and a roller 82 rotatably supported in the bracket 80. The preferred metal for forming the bracket 80 is aluminum or stainless steel. However, any suitable metal may be used for forming the bracket 80. The roller 82 is formed of a high impact strength plastic material, such as a high density polyethylene, nylon or the like.

Figure 6:
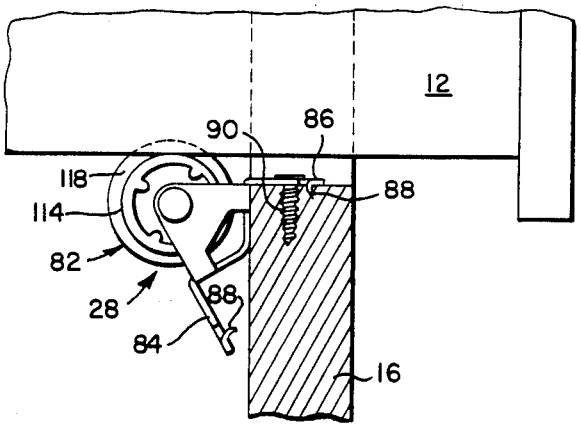
FIG. 6 is a side elevation, partly in section, of parts of a cabinet and of a drawer, with the universal single roller bracket of FIG. 3 secured to the cabinet part.

The metal bracket 80 also is formed with a pair of flat mounting flanges 84 and 86. These flanges 84 and 86 are provided with a plurality of spear points 88 formed integrally therewith. The spear points 88 are provided for initially holding the hybrid embodiment 28 of the universal single roller bracket in place prior to its being more permanently secured to the cabinet 14, as by being stapled or screwed thereto by one or more screws 90, observe FIG. 6. In order to facilitate the use of screws 90 or staples, the flanges 84 and 86 further are provided with a plurality of apertures 92. The flanges 84 and 86 also are formed in planes 94 and 96 converging (or diverging) at an angle 98 toward an apex 100 and defining an axis 102 near the apex 100. Again, it is these flanges 84 and 86 and their disposition in the planes 94 and 96 that provide the bracket with its unique, universal (i.e., both left and right) and self-positioning characteristics. Again, this angle 98 is about 60°. A pair of spaced parallel roller supports 104 and 106 extend from the apex 100 in spaced parallel planes normal to the axis 102 and connect with the mounting flanges 84 and 86. Here, both roller supports 104 and 106 are of triangular shape. Each of the pair of roller supports 104 and 106 is provided with a hole 108 and 110, respectively, both being concentric with the axis 102. The holes 108 and 110 are designed to accomodate a pin 112. The pin 112, with the roller 82 in place, is designed rotatably to support the roller 82 thereabout and thus about the axis 102.

The plastic roller 82 also is formed with a cylindrical outer periphery 114 and a central tubular hub 116. Unlike the roller 66 however, the roller 82 further is provided with a flanged shoulder 118 to serve as a side guide for the drawer 12, observe FIG. 6. The central tubular hub 116 of the roller 82 has an axial hole 120 to accomodate the pin 112 therethrough.

Thus it has been shown and described a universal single roller bracket 10 designed for use with sliding drawers 12 in cabinets 14, bureaus, chests and the like, which bracket 10 satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. A universal single roller bracket for use in the corners of a cabinet opening for a drawer comprising:

(a) a unitary bracket;

(b) a pair of flat mounting flanges formed integrally with said bracket;

(c) said pair of flat mounting flanges formed in respective planes converging at an acute angle toward an apex and defining an axis near said apex;

(d) a pair of spaced parallel roller supports formed integrally with said bracket and in planes normal to said axis, at least one of said pair of spaced parallel roller supports being bounded by said respective planes converting at said acute angle toward said apex; and (e) a roller supported with said supports for rotation about said axis, said roller formed of a plastic material.

2. The universal single roller bracket of claim 1 wherein said unitary bracket is formed of a plastic material, said plastic material being a high density polyethylene characterized by high impact strength.

3. The universal single roller bracket of claim 1 wherein said unitary bracket is formed of metal, and wherein said pair of flat mounting flanges are provided with a plurality of integral spear points.

4. The universal single roller bracket of claim 1 wherein each one of said pair of flat mounting flanges is designed alternately to be used as means whereby said bracket is respectively secured in said corners of said cabinet opening, and wherein one of said pair of spaced 5. A universal single roller bracket for use in the corner of a cabinet opening for a drawer comprising:

(a) a unitary bracket formed of a plastic material, said plastic material being a high density polyethylene characterized by high impact strength;

(b) a pair of flat mounting flanges formed integrally with said bracket in respective planes converging at an acute angle toward an apex and defining an axis adjacent said apex;

(c) a pair of spaced parallel roller supports formed integrally with said plastic bracket and in planes normal to said axis;

(d) one of said pair of spaced parallel roller supports also serving as a side guide for said drawer;

(e) a roller also formed of a plastic material and supported within said supports for rotation about said axis;

(f) each one of said pair of flat mounting flanges formed in said planes converging at said acute angle designed alternatively to be used as means whereby said bracket is fastened in one of said corners of said cabinet;

(g) said bracket being fastened in one of said corners of said cabinet by being stapled thereto through one of said pair of flat mounting flanges.

6. A universal single roller bracket for use in the corner of a cabinet opening for a drawer comprising:

(a) a unitary bracket formed of a plastic material;

(b) a pair of flat mounting flanges formed integrally with said bracket in respective planes converging at an angle toward an apex and defining an axis adjacent said aped;

(c) a pair of spaced parallel roller supports formed integrally with said bracket and in planes normal to said axis;

(d) one of said pair of spaced parallel roller supports also serving as a side guide for said drawer;

(e) a roller also formed of a plastic material and supported within said supports for rotation about said axis;

(f) each one of said pair of flat mounting flanges designed alternately to be used as means whereby said bracket is fastened in one of said corners of said cabinet, wherein said angle is about 60°.

7. A universal single roller bracket for use in the corners of a cabinet opening for a drawer comprising:

(a) a unitary bracket formed of metal;

(b) a pair of flat mounting flanges integrally formed with said bracket in respective planes converging at an acute angle toward an apex and defining an axis adjacent said apex;

(c) a pair of parallel spaced roller supports formed integrally with said bracket and in planes normal to said axis, said pair of parallel spaced roller supports bounded by said respective planes converging at said acute angle toward said apex;

(d) a roller formed of a plastic material and supported within said supports for rotation about said axis, and (e) a flanged shoulder provided on one side of said roller to serve as a side guide for said drawer;

(f) each of said parallel spaced roller supports provided with an opening about said axis, a pin designed to be secured with said openings, said pin rotatably supporting said roller.

8. The universal single roller bracket of claims 7 wherein one of said pair of parallel spaced roller supports has edges, said edges lying in said respective planes of said pair of flat mounting flanges, and wherein said apex is defined by the ends of said roller supports.

9. The universal single roller bracket of claim 7 wherein said metal is formed of the group including stainless steel, aluminum or steel.

10. A universal single roller bracket for use in the corners of a cabinet opening for a drawer comprising:

(a) a unitary bracket formed of metal;

(b) a pair of flat mounting flanges integrally formed with said bracket in repective planes converging at an angle toward an apex and defining an axis adjacent said apex;

(c) a pair of parallel spaced roller supports formed integrally with said bracket and in planes normal to said axis;

(d) a roller formed of a plastic material and supported withing said supports for rotation about said axis; and (e) a flanged shoulder provided on one side of said roller to serve as a side guide for said drawer;

(f) said angle being about 60° .

* * * * *